US007236717B2

(12) United States Patent
Shinkawa et al.

(10) Patent No.: US 7,236,717 B2
(45) Date of Patent: Jun. 26, 2007

(54) ROTATABLE ROLLER, IMAGE FORMING APPARATUS EMPLOYING SAME, AND IMAGE FORMING APPARATUS CARTRIDGE EMPLOYING SAME

(75) Inventors: Kohji Shinkawa, Nara (JP); Hiroshi Ishii, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 11/086,574

(22) Filed: Mar. 23, 2005

(65) Prior Publication Data

US 2005/0213998 A1 Sep. 29, 2005

(30) Foreign Application Priority Data

Mar. 29, 2004 (JP) ..... 2004-095914

(51) Int. Cl.
*G03G 15/00* (2006.01)
*G03G 15/02* (2006.01)
*G03G 15/20* (2006.01)

(52) U.S. Cl. ..... 399/107; 399/176; 399/313

(58) Field of Classification Search ..... 399/24, 399/107, 109, 174, 175, 176, 313, 318, 357
See application file for complete search history.

(56) References Cited

U.S. PATENT DOCUMENTS 2,610,882 A * 9/1952 Sutliffe ..... 294/1.1
5,763,038 A * 6/1998 Wood ..... 428/43
6,408,151 B1 * 6/2002 Heno ..... 399/107
6,954,963 B2 * 10/2005 McKay ..... 15/104.002

FOREIGN PATENT DOCUMENTS

| | | | |
|---|---|---|---|
| JP | 08-171259 | * | 7/1996 |
| JP | 10-225969 | | 8/1998 |
| JP | 2000-235294 | | 8/2000 |
| JP | 2002-251053 | | 9/2002 |
| JP | 2004-157153 | | 6/2004 |

* cited by examiner

*Primary Examiner*—Sandra L. Brase
(74) *Attorney, Agent, or Firm*—Nixon & Vanderhye, PCC.

(57) ABSTRACT

As outermost coating-like layer(s) of charging roller(s) is or are made to contact and/or slide against photosensitive drum(s), charge is applied from the outermost coating-like layer(s) to the photosensitive drum(s), charging the photosensitive drum(s). This being the case, resistance of the outermost coating-like layer(s) of the charging roller(s) fluctuates, and surface(s) thereof become scratched and so forth, and gradually deteriorate. Moreover, if remedial action is not taken, charging capability of the charging roller(s) may decrease, leading to nonuniformity in charging of the photosensitive drum(s) and causing lowering of image quality and/or reduction in service life of the photosensitive drum(s). The outermost coating-like layer(s) of the charging roller(s) is or are therefore periodically stripped off therefrom to rejuvenate the charging roller surface(s).

21 Claims, 8 Drawing Sheets

(a)

(b)

ROTATABLE ROLLER, IMAGE FORMING APPARATUS EMPLOYING SAME, AND IMAGE FORMING APPARATUS CARTRIDGE EMPLOYING SAME

TECHNICAL BACKGROUND

This application claims priority under 35 USC 119(a) to Patent Application No. 2004-95914 filed in Japan on 29 Mar. 2004, the content of which is hereby incorporated herein by reference in its entirety.

The technology disclosed herein pertains to rotatable roller(s) rotating with an outer circumferential surface(s) thereof contacting and/or sliding against at least one electrostatic latent image carrier(s), and pertains to image forming apparatus(es) employing same, and pertains to image forming apparatus cartridge(s) employing same.

As is known, in electrophotographic image forming apparatuses, as a photosensitive drum (electrostatic latent image carrier) is made to rotate, a charging apparatus causes the surface of the photosensitive drum to become uniformly charged; a beam of light is scanned across the surface of the photosensitive drum, forming an electrostatic latent image on the photosensitive drum; developer is made to adhere to the electrostatic latent image on the photosensitive drum, forming a development image on the photosensitive drum; the development image is transferred from the photosensitive drum to recording paper; and heat and pressure are applied to the development image on the recording paper to fuse it thereon.

Here, the charging apparatus may be a device using corona discharge to generate/apply charge, a device using contact with roller(s) to generate/apply charge, and so forth. The former, i.e., corona-discharge-type charging apparatuses, are advantageous in that they apply charge to the photosensitive drum in noncontact fashion and in that they cause the surface of the photosensitive drum to become uniformly charged. However, they have the disadvantage that they produce a large amount of ozone.

Furthermore, the latter, i.e., charging apparatuses making use of contact with roller(s), have the advantage that they produce almost no ozone, charging of the photosensitive drum being accomplished as a result of causing the photosensitive drum surface to be contacted by roller(s) to which bias voltage(s) has or have been applied. However, as there is a tendency for roller surface(s) to deteriorate, it will be necessary to periodically carry out replacement of roller(s).

Art has therefore been disclosed, e.g. at Japanese Patent Application Publication Kokai No. 2000-235294 (hereinafter "Patent Reference No. 1"), in which an electrically conductive elastic roller is inserted within an electrically conductive tube, the electrically conductive tube and the electrically conductive elastic roller being made to rotate in idler fashion by the photosensitive body as the electrically conductive elastic roller is pressed against the photosensitive body. Because the inside diameter of the electrically conductive tube is greater than the outside diameter of the electrically conductive elastic roller, replacement thereof is simple, and it is possible to easily rejuvenate the electrically conductive tube surface when this has deteriorated due to contact with the photosensitive drum.

However, with Patent Reference No. 1, because there is a gap between the electrically conductive tube and the electrically conductive elastic roller, when the electrically conductive tube and the electrically conductive elastic roller are made to rotate in idler fashion by the photosensitive body, the locus at which the electrically conductive elastic roller contacts the electrically conductive tube is always changing in unstable fashion. This being the case, it is possible that resistance between the electrically conductive elastic roller and the photosensitive drum will be unstable, and that charging of the photosensitive drum by the electrically conductive elastic roller and the electrically conductive tube will also be unstable.

Accordingly, for stable charging of the photosensitive drum, there being no alternative but to employ a roller in which an electrically conductive film is in intimate contact with the roller surface, roller replacement has been unavoidable.

Furthermore, this sort of problem which has been described with respect to charging rollers has also been shared by charge removal rollers coming in contact with photosensitive drum(s) or the like and removing charge therefrom, cleaning rollers coming in contact with photosensitive drum(s) or the like and carrying out cleaning thereof, transfer rollers transferring development image(s) from photosensitive drum surface(s) to recording paper, and so forth, where it has also been necessary to carry out roller replacement in the event of deterioration of the roller surface.

The technology disclosed herein was therefore conceived in light of the foregoing conventional issues, it being an object thereof to provide a rotatable roller capable of imparting electric potential(s) in stable fashion and having outer circumferential surface(s) capable of being easily rejuvenated in the event of deterioration thereof.

Furthermore, it is an object of the technology disclosed herein to provide an image forming apparatus and an image forming apparatus cartridge employing the aforementioned rotatable roller(s) in accordance with the technology disclosed herein.

SUMMARY

In order to solve the foregoing and/or other problems, a rotatable roller in accordance with one or more embodiments of the technology disclosed herein comprises a plurality of coating-like layers sequentially strippably laminated at an outer circumference; and capable of rotating with an outer circumferential surface thereof contacting and/or sliding against at least one electrostatic latent image carrier.

A rotatable roller in accordance with one or more embodiments of the technology disclosed herein is such that there are a plurality of the coating-like layers sequentially strippably laminated at the outer circumferential surface thereof. This being the case, when outermost coating-like layer surface(s) of the rotatable roller become deteriorated, it will be possible, by stripping off such coating-like layer(s) therefrom, to reveal subsequent coating-like layer surface(s) and rejuvenate the rotatable roller surface(s). This will make it possible for electric potential(s) to be imparted in stable fashion to the electrostatic latent image carrier(s). Furthermore, because rejuvenation of surface(s) of the rotatable roller is facilitated, it is possible to minimize the damage incurred by the electrostatic latent image carrier surface(s).

In the foregoing constitution, the rotatable roller may further comprise one or more cores; and one or more intermediate members provided about at least one of the core or cores; wherein the plurality of coating-like layers are laminated about at least one of the intermediate member or members.

In such case, it will be possible to appropriately choose elasticity or elasticities and so forth of the intermediate member(s) so as to adjust the manner in which the coating-like layers contact the electrostatic latent image carrier(s).

In the foregoing constitution, at least a portion of at least one of the respective coating-like layers may be colored.

Where this is the case, because at least a portion of at least one of the respective coating-like layers is colored, ability to discern place in the order of lamination, number of remaining layers, and so forth at the respective coating-like layers will be facilitated.

In the foregoing constitution, stripping off any of the respective coating-like layers may cause at least a part of the colored portion to be made visible.

Where this is the case, because stripping off any of the respective coating-like layers causes at least a part of the colored portion to be made visible, ability to determine number of remaining layers and so forth at the respective coating-like layers will be facilitated.

In the foregoing constitution, at least one of the respective coating-like layers may have one or more tags attached thereto.

Where this is the case, because at least one of the respective coating-like layers has one or more tags attached thereto, ability to discern place in the order of lamination, number of remaining layers, and so forth at the respective coating-like layers will be facilitated. Furthermore, stripping off at least one of the tag or tags may facilitate stripping off of at least one of the coating-like layers together therewith.

In particular, in the foregoing constitution, marked on at least one of the tag or tags there may be an order in which at least one of the coating-like layer or layers to which at least one of the tag or tags is attached is to be stripped off.

Where this is the case, because at least one of the respective coating-like layers has one or more tags attached thereto, and because marked on at least one of the tag or tags there is an order in which at least one of the coating-like layer or layers to which at least one of the tag or tags is attached is to be stripped off, ability to discern place in the order of lamination, number of remaining layers, and so forth at the respective coating-like layers will be further facilitated. Furthermore, stripping off at least one of the tag or tags may facilitate stripping off of at least one of the coating-like layers together therewith.

Where, as described above, the coating-like layer(s) is/are colored and/or has/have tag(s) attached thereto, making it possible to know place in the order of lamination, number of remaining layers, and so forth at the coating-like layer(s), because it will be possible to estimate time(s) that the rotatable roller(s) has/have been in use, and because it will also be possible to judge time(s) that other component(s) and/or the like in vicinity or vicinities of the rotatable roller(s) has/have been in use, it will be possible to use place in the order of lamination, number of remaining layers, and/or the like at the coating-like layer(s) as benchmark(s) for determining recycle time(s).

In the foregoing constitution, perforation may be present at at least a portion of at least one of the respective coating-like layers.

Where this is the case, because the perforation is present at at least a portion of at least one of the respective coating-like layers, it will be possible to cause the coating-like layer(s) to easily tear along the perforation, facilitating stripping off of the coating-like layer(s).

The foregoing constitution may be such that the perforation is not present at at least one region where at least one of the coating-like layers contacts and/or slides against at least one of the electrostatic latent image carrier or carriers.

Where this is the case, because the perforation is formed such that it is not present at at least one region where at least one of the coating-like layers contacts and/or slides against at least one of the electrostatic latent image carrier or carriers, it is possible to avoid any effect that the perforation might otherwise have on the electrostatic latent image carrier(s).

The foregoing constitution may be such that the perforation is formed in parallel fashion with respect to at least one direction of calendering of synthetic resin sheeting making up at least one of the coating-like layers.

Where this is the case, because the perforation is formed in parallel fashion with respect to at least one direction of calendering of synthetic resin sheeting making up at least one of the coating-like layers, it will be possible to cause the coating-like layer(s) to more easily tear along the perforation.

In the foregoing constitution, electrically conductive adhesive may be present between adjacent layers of the respective coating-like layers.

Where this is the case, because the electrically conductive adhesive is present between adjacent layers of the respective coating-like layers, resistance between the respective coating-like layers is reduced and the resistance of the rotatable roller itself is made stable. Furthermore, it will be possible to definitively secure and support the respective coating-like layers, it will be possible to prevent occurrence of twisting, wrinkling, and/or the like at the coating-like layer(s), and it will be possible for electric potential(s) to be imparted in more stable fashion to the electrostatic latent image carrier (s).

In the foregoing constitution, the respective coating-like layers may be brought into mutual intimate contact through contraction thereof.

Where this is the case, because the respective coating-like layers are brought into mutual intimate contact through contraction thereof, resistance between the respective coating-like layers can be reduced, the resistance of the rotatable roller itself can be made stable, and occurrence of twisting, wrinkling, and/or the like at the coating-like layer(s) can be prevented. Furthermore, it will in such case be possible to forego use of electrically conductive adhesive, making it possible to achieve reduction in cost.

More specifically, in the foregoing constitution, the respective coating-like layers may comprise a plurality of concentrically laminated tubes.

More specifically, in the foregoing constitution, the respective coating-like layers may be formed in laminated fashion such that a single sheet is wrapped thereabout a plurality of times.

In the foregoing constitution, the respective coating-like layers may be partitioned by perforation formed on the sheet so as to extend in substantially the long direction of the rotatable roller.

Where this is the case, because the respective coating-like layers are partitioned by the perforation formed on the sheet so as to extend in substantially the long direction of the rotatable roller, it is possible, by causing the perforation partitioning the respective coating-like layers not to appear at the surface of the rotatable roller, to avoid any effect that the perforation might otherwise have on the electrostatic latent image carrier(s).

In the foregoing constitution, each of the coating-like layers may be of such length as to cause the two edges of the coating-like layer to mutually overlap.

Where this is the case, because each of the coating-like layers is of such length as to cause the two edges of the coating-like layer to mutually overlap, it is possible, by causing the perforation partitioning the respective coating-like layers not to appear at the surface of the rotatable roller, to avoid any effect that the perforation might otherwise have on the electrostatic latent image carrier(s).

In the foregoing constitution, the respective coating-like layers may have mutually different resistances, the more outwardly located the coating-like layer the lower being the resistance thereof.

Where this is the case, because the respective coating-like layers have the mutually different resistances, the more outwardly located the coating-like layer the lower being the resistance thereof, it is possible to reduce any change in resistance of the rotatable roller that might otherwise accompany stripping off of the respective coating-like layers therefrom.

Moreover, an image forming apparatus in accordance with one or more embodiments of the technology disclosed herein comprises at least one of the rotatable roller or rotatable rollers according to any of the foregoing embodiments of the technology disclosed herein.

An image forming apparatus comprising rotatable roller (s) according to embodiment(s) of the technology disclosed herein will be capable of achieving operation and effect similar to that of rotatable roller(s) according to embodiment (s) of the technology disclosed herein as described above.

Furthermore, an image forming apparatus constituted as described above in accordance with one or more embodiments of the technology disclosed herein may further comprise one or more control means recording usage history information pertaining to at least one of the rotatable roller or rotatable rollers, and ascertaining, based on at least a portion of the usage history information, at least one time at which at least one of the coating-like layers of at least one of the rotatable roller or rotatable rollers should be stripped off.

Where this is the case, because the control means is/are provided, it is possible at appropriate time(s) to strip off the coating-like layer(s) and rejuvenate the rotatable roller surface(s). As a result, it is possible to minimize the damage incurred by the electrostatic latent image carrier surface(s), making it possible to increase longevity of the electrostatic latent image carrier(s).

Furthermore, an image forming apparatus constituted as described above in accordance with one or more embodiments of the technology disclosed herein may further comprise one or more report means reporting at least one time at which at least one of the coating-like layers of at least one of the rotatable roller or rotatable rollers should be stripped off.

Where this is the case, because the report means is/are provided, user(s) need not go to any great lengths with regard to time(s) at which the coating-like layer(s) of the rotatable roller(s) should be stripped off.

In the foregoing constitution, at least a portion of the usage history information pertaining to at least one of the rotatable roller or rotatable rollers may be at least one member selected from among the group consisting of at least one number of times that at least one of the rotatable roller or rotatable rollers has been electrically charged; at least one number of rotations of at least one of the rotatable roller or rotatable rollers; and at least one time that at least one of the rotatable roller or rotatable rollers has spent rotating.

In the foregoing constitution, at least a portion of the usage history information pertaining to at least one of the rotatable roller or rotatable rollers may be ascertained based on at least one member selected from among the group consisting of at least one number of images recorded by at least one of the electrostatic latent image carrier or carriers; at least one number of rotations of at least one of the electrostatic latent image carrier or carriers; and at least one time that at least one of the electrostatic latent image carrier or carriers has spent rotating.

Furthermore, an image forming apparatus cartridge in accordance with one or more embodiments of the technology disclosed herein comprises at least one of the rotatable roller or rotatable rollers according to any of the foregoing embodiments of the technology disclosed herein; and is capable of being removably installed in one or more image forming apparatuses.

An image forming apparatus cartridge comprising rotatable roller(s) according to embodiment(s) of the technology disclosed herein will be capable of achieving operation and effect similar to that of rotatable roller(s) according to embodiment(s) of the technology disclosed herein as described above.

DESCRIPTION OF EXAMPLE EMBODIMENTS

Below, embodiments of the technology disclosed herein are described in detail while referring to the attached drawings.

First Embodiment

Figure 1:
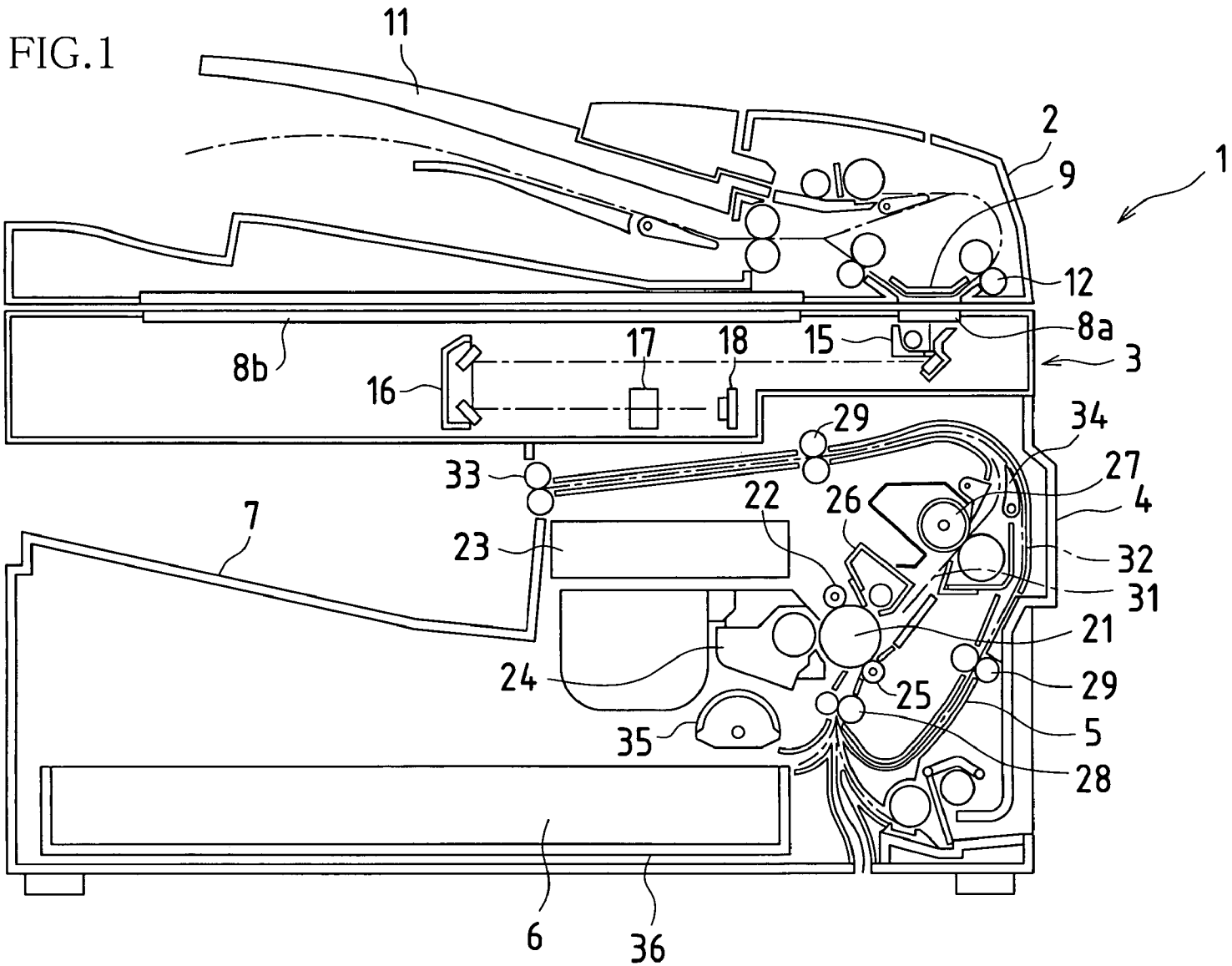
FIG. 1 is a side view showing a first embodiment of an image forming apparatus in accordance with the technology disclosed herein.
Figure 2:
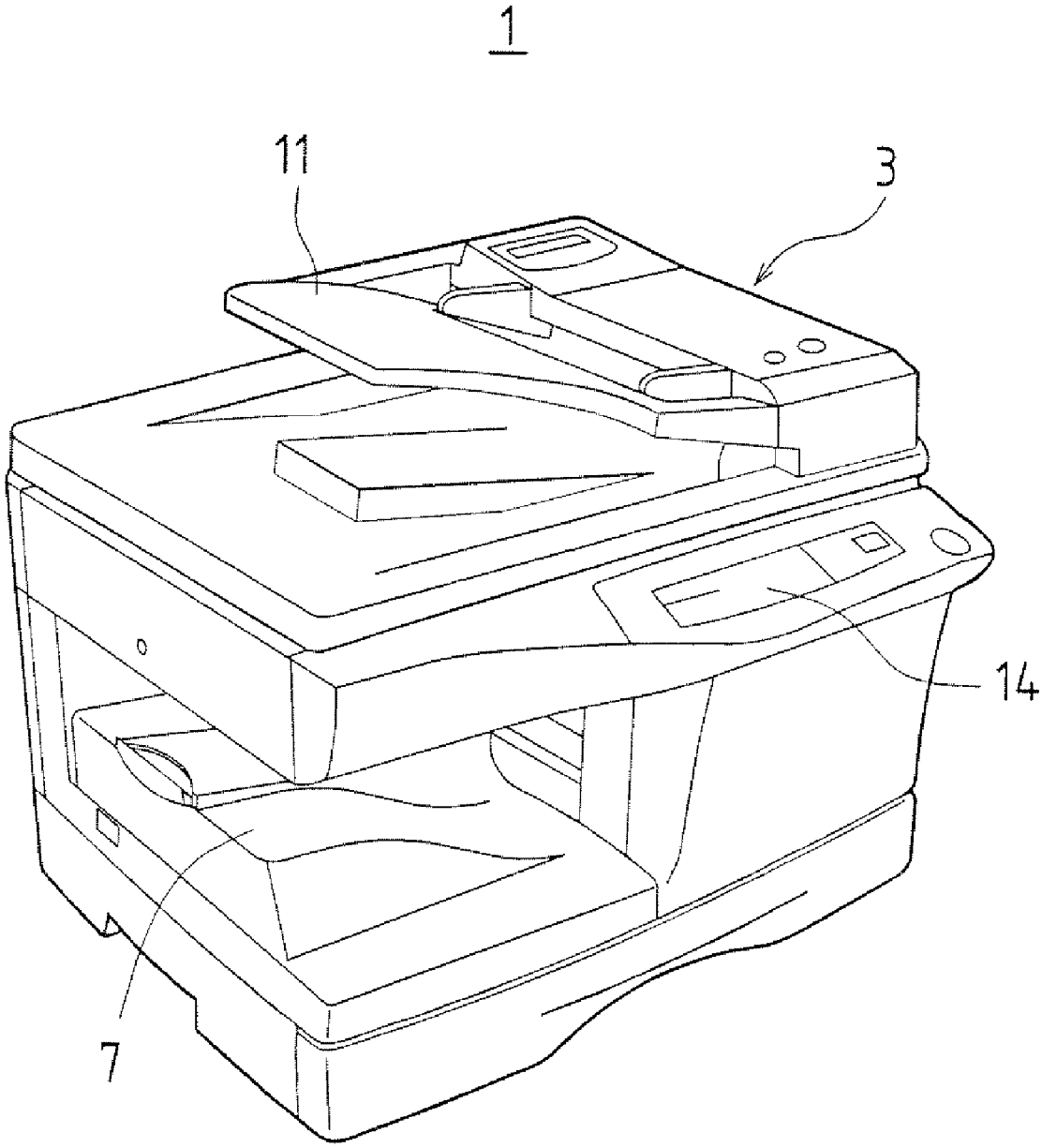
FIG. 2 is an oblique view showing the image forming apparatus of FIG. 1.

FIG. 1 is a side view showing a first embodiment of an image forming apparatus in accordance with the technology disclosed herein. Furthermore, FIG. 2 is an oblique view showing the image forming apparatus of the present embodiment. This image forming apparatus 1 is capable of selective operation pursuant to copier mode in which original image (s) is/are captured and is/are printed on recording paper; facsimile mode in which original image(s) is/are captured and is/are transmitted, and/or in which original image(s) is/are received and is/are printed on recording paper; printer mode in which image(s) received via network(s) from information terminal apparatus(es) is/are printed on recording paper; and so forth. Describing its structure in broad terms, this image forming apparatus 1 comprises original transport unit or units 2, capturing unit or units 3, printing unit or units 4, recording paper transport unit or units 5, media supply unit or units 6, and media discharge unit or units 7.

Next, taking copier mode as example, operation of image forming apparatus 1 will be described.

At original transport unit 2, when at least one original sheet is placed on original input tray 11, original(s) are taken up one sheet at a time from original input tray 11 and are transported; and when the lead edge of the original reaches PS (paper separation) roller(s) 12, transport of the original is temporarily stopped and the lead edge of the original is made parallel to PS roller(s) 12. Furthermore, after achieving synchronization with respect to image recording operations taking place at printing unit 4, clutch(es) between drive shaft(s) and PS rollers 12 is/are engaged, causing PS rollers 12 to be driven in rotating fashion; and transport of the original being resumed by PS rollers 12, the original is made to pass between glass platen 8*a* and original backpressure plate 9.

At original capturing apparatus 3, during transport of the original, first scanning unit 15 exposes the original; first and second scanning units 15, 16 direct light reflected from the original toward imaging lens(es) 17; and imaging lens(es) 17 form an image of the original on optical-to-electrical conversion element(s) (hereinafter "CCD") 18. CCD 18 captures the original through repeated scanning of same in the scan direction, and outputs image data representing the original.

Furthermore, in the event that the original is placed on glass platen 8*b*, first and second scanning units 15, 16 are made to move with prescribed relative speeds being maintained therebetween; first scanning unit 15 exposes the original on glass platen 8*b*; first and second scanning units 15, 16 direct light reflected from the original toward imaging lens(es) 17; and imaging lens(es) 17 form an image of the original on CCD 18.

Image data output by CCD 18 is subjected to various types of image processing carried out by microcomputer or other such control circuit(s), and is thereafter output to printing unit 4.

Printing unit 4, which records image(s) of the original represented by the image data onto recording paper, comprises photosensitive drum(s) 21, roller-type charging apparatus(es) 22, laser scanning unit(s) (hereinafter "LSU") 23, development unit(s) 24, transfer unit(s) 25, cleaning unit(s) 26, charge-removing unit(s) (not shown), fusing unit(s) 27, and so forth. Photosensitive drum 21 rotates in unidirectional fashion, and after the surface thereof has been cleaned by cleaning unit 26 and charge-removing unit(s), the surface thereof is uniformly charged by roller-type charging apparatus 22. Laser scanning unit 23 modulates laser light in correspondence to the image data and causes this laser light to be repeatedly scanned in the scan direction across the surface of photosensitive drum 21, forming an electrostatic latent image on the surface of photosensitive drum 21. Development unit 24 supplies toner to the surface of photosensitive drum 21, developing the electrostatic latent image and forming a visible toner image on the surface of photosensitive drum 21. Transfer unit 25 transfers the visible toner image on the surface of photosensitive drum 21 onto recording paper transported thereto by recording paper transport unit 5. Fusing unit 27 applies heat and pressure to the recording paper, fusing the visible toner image on the recording paper. The recording paper is thereafter further transported toward media discharge tray 7 by recording paper transport unit 5, and is discharged.

For transport of recording paper, recording paper transport unit 5 comprises PS rollers 28, transport rollers 29, transport path(s) 31, flipping transport path(s) 32, discharge rollers 33, diverter paddle(s) 34, and so forth. At transport path 31, recording paper is accepted from media supply unit 6, transport of recording paper being temporarily stopped and the lead edge of the recording paper being made parallel to PS rollers 28 when the lead edge of the recording paper reaches PS rollers 28, following which PS rollers 28 cause the recording paper to be transported toward transfer unit 25 of printing unit 4, and the recording paper is furthermore transported toward media discharge unit 7. Furthermore, where image(s) is/are also to be recorded on the back side of the recording paper, diverter paddle 34 is made to move in rotational fashion, switching the diverting path between transport path 31 and flipping transport path 32, following which the recording paper is transported in reverse direction from transport path 31 to flipping transport path 32. At flipping transport path 32, when recording paper is accepted from transport path 31, the recording paper is flipped such that front and back thereof are reversed, following which the recording paper is made to return to PS rollers 28 of transport path 31. This makes it possible for image(s) to also be recorded on the back side of the recording paper. Arranged at these transport paths 31, 32 are a plurality of detection switches for detecting passage of recording paper therethrough, control of recording paper transport timing and so forth being carried out based on detection occurring at the respective detection switches.

Media supply unit 6, which stores unused recording paper and which supplies this unused recording paper to recording paper transport unit 5, comprises media supply cassette(s) 36. Stored in stacked fashion within media supply cassette 36 is recording paper, this recording paper being taken up one sheet at a time and transported therefrom by half-moon-shaped takeup roller(s) 35. In addition, after being taken up from media supply cassette 36, the recording paper is transported toward PS rollers 28.

Figure 3:
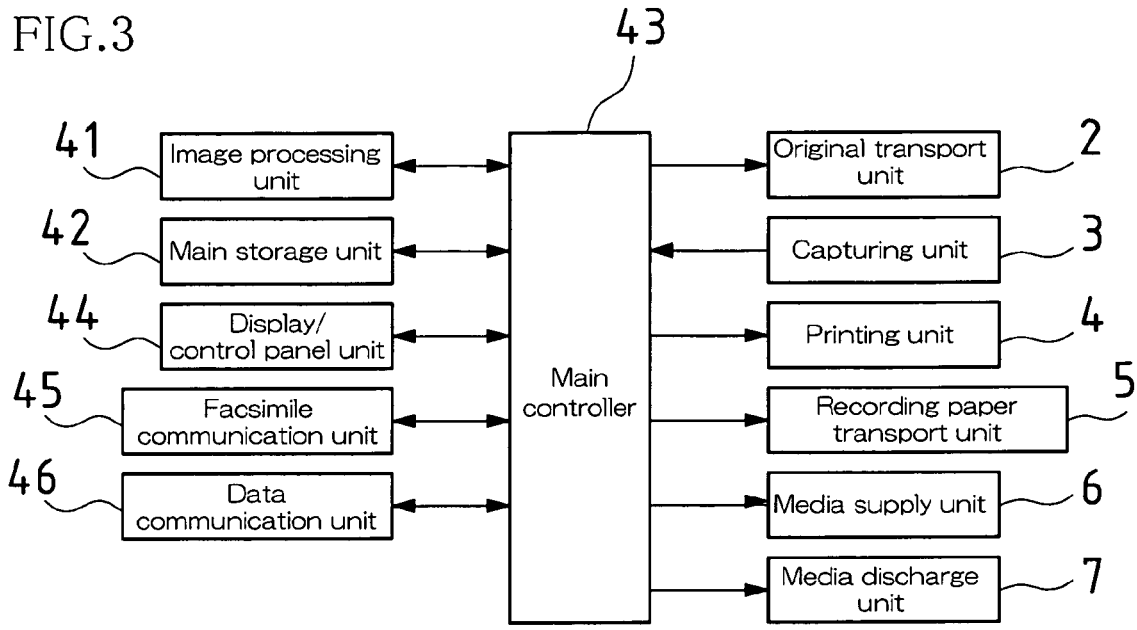
FIG. 3 is a block diagram showing the structure of the image forming apparatus of FIG. 1.

FIG. 3 is a block diagram showing the structure of image forming apparatus 1. In addition to original transport unit or units 2, capturing unit or units 3, printing unit or units 4, recording paper transport unit or units 5, media supply unit or units 6, and media discharge unit or units 7 mentioned above, this image forming apparatus 1 comprises image processing unit(s) 41, main storage unit(s) 42, main controller(s) 43, display/control panel unit(s) 44, facsimile communication unit(s) 45, data communication unit(s) 46, and so forth.

Image processing unit 41 processes image data output from CCD 18. Among the types of processing which may be carried out on image data by this image processing unit 41 are shading correction, optical density correction, image segmentation processing, filter processing, MTF correction, resolution conversion, electronic zoom (processing to change magnification), gamma compensation, and so forth.

Main storage unit 42 may store pre-processing image data and/or post-processing image data; and/or may store various program(s), data table(s), and/or the like for performance of image processing, and/or various other such program(s), data table(s), and/or the like for performance of operations carried out by image forming apparatus 1.

Main controller 43 carries out control of image forming apparatus 1 in comprehensive fashion; e.g., controlling capturing unit 3, printing unit 4, recording paper transport unit 5, media supply unit 6, media discharge unit 7, and so forth.

Display/control panel unit 44 detects input from control panel(s) 14 (see FIG. 2) comprising touch panel(s) and/or operation keypad(s), and controls display at liquid crystal display unit(s) of control panel(s) 14.

Facsimile communication unit 45 places calls to external terminal(s) by way of network(s) to transmit image data to external terminal(s), and/or receives calls from external terminal(s) by way of network(s) to receive image data from external terminal(s).

Data communication unit 46 transceives image data to/from external terminal(s) by way of LAN(s) and/or the like.

Figure 4:
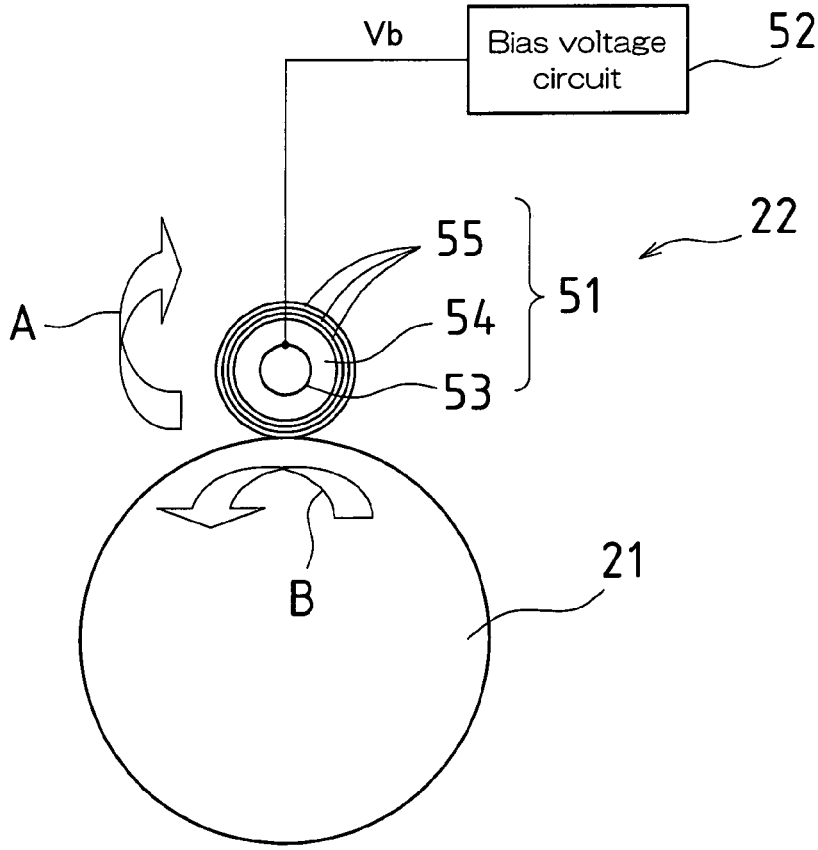
FIG. 4 is a side view showing a rotatable roller-type charging apparatus in the image forming apparatus of FIG. 1.

Next, roller-type charging apparatus 22 is described in further detail. FIG. 4 is a side view showing roller-type charging apparatus 22. At this roller-type charging apparatus 22, bias voltage Vb from bias voltage circuit 52 is applied to charging roller 51, charging roller 51 is made to press against the surface of photosensitive drum 21, and charging roller 51 and photosensitive drum 21 are respectively made to rotate in the directions indicated by arrows A and B at identical circumferential speeds, causing the surface of photosensitive drum 21 to become charged.

Bias voltage Vb, which is output by bias voltage circuit 52 and which is applied to charging roller 51, may be DC voltage(s) and/or may be DC voltage(s) on which AC voltage(s) is/are superposed. Furthermore, bias voltage circuit 52 varies bias voltage Vb in response to control from main controller 43.

Where DC bias voltage(s) Vb is/are employed, the amount of ozone produced will be small.

Furthermore, where bias voltage(s) Vb is/are employed that is/are DC voltage(s) on which AC voltage(s) is/are superposed, large amounts of ozone will be produced but it will be possible to limit nonuniformity in charging of the surface of photosensitive drum 21.

Figure 5:
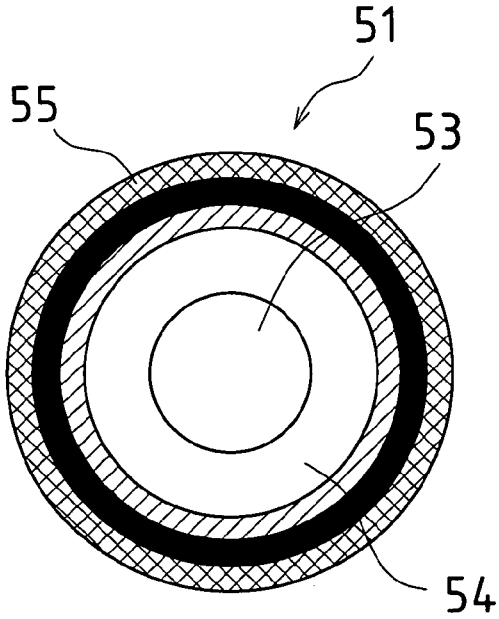
FIGS. 5(*a*) and (*b*) are sectional views showing a charging roller in the rotatable roller-type charging apparatus of FIG. 4 as seen from the side and as seen from the front.
Figure 5:
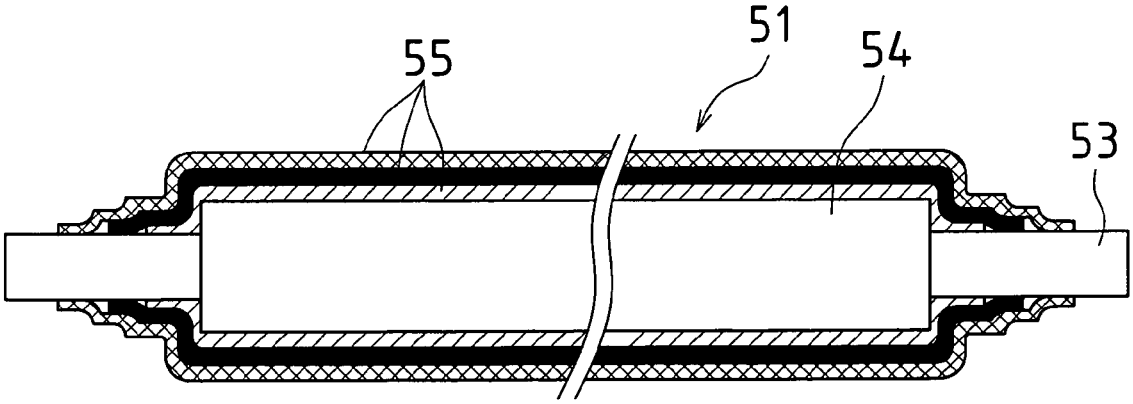

FIG. 5(*a*) and (*b*) are sectional views showing charging roller 51 as seen from the side and as seen from the front. As is clear from FIG. 5(*a*) and (*b*), charging roller 51 comprises elastic member 54 provided about rotatable shaft 53, elastic member 54 being enclosed within a plurality of coating-like layers 55; moreover, rotatable shaft 53, elastic member 54, and respective coating-like layers 55 are arranged in concentric fashion. Rotatable shaft 53 is made of metal; elastic member 54 and respective coating-like layers 55 are electrically conductive. Accordingly, bias voltage Vb from bias voltage circuit 52 can be applied to respective coating-like layers 55 via rotatable shaft 53 and elastic member 54.

Rotatable shaft 53 might, for example, be a shaft made of stainless steel, aluminum, or the like which is 8 mm in diameter.

Elastic member 54 may be a sponge-like or solid member comprising urethane, EPDM, silicone resin, chloroprene, and/or the like in which electrically conductive particles have been mixed; the thickness thereof being on the order of 3 mm, and the volume resistance thereof being $10^1$ Ω·cm to $10^6$ Ω·cm. As electrically conductive particles, electrically conductive carbon black, zinc oxide, aluminum oxide, and/or other such metallic powder(s), metallic salt(s) having ionic conductivity, and/or the like may be used.

Respective coating-like layers 55 may be tube-like members comprising urethane, elastomer, nylon, and/or the like in which electrically conductive particles have been mixed; the thickness thereof being on the order of 10μ to 300μ (preferably 30μ to 150μ), and the volume resistance thereof being $10^4$ Ω·cm to $10^9$ Ω·cm (preferably $10^5$ Ω·cm to $10^7$ Ω·cm). As electrically conductive particles, the same substance(s) as were mentioned in connection with elastic member 54 may be used. Furthermore, respective coating-like layers 55 have an Asker C hardness of 40 to 90 (preferably 50 to 70), and have a 10-point average surface roughness of not more than Rz 20μ (preferably not more than 5μ).

Elastic member 54 is inserted within coating-like layers 55, following which coating-like layers 55 are heated and made to contract in heat-shrink fashion. As a result, the innermost of coating-like layers 55 being brought into intimate contact with elastic member 54, and the outer layer(s) among respective coating-like layers 55 being brought into intimate contact with the inner layer(s) among coating-like layers 55, all of respective coating-like layers 55 are definitively secured.

Here, the reason that elastic member 54 and respective coating-like layers 55 are given electrical conductivity is so that when bias voltage Vb is applied to respective coating-like layers 55 via rotatable shaft 53 and elastic member 54, charge can be imparted from the outermost among coating-like layers 55 to photosensitive drum 21.

Furthermore, the reason that respective coating-like layers 55 are given appropriate volume resistances is so that the charge applied thereto is not concentrated at any one location on photosensitive drum 21.

Moreover, the volume resistances of respective coating-like layers 55 are chosen such that the more outwardly located the coating-like layer the lower is the resistance thereof. For example, taking volume resistance of the outermost among the coating-like layers 55 to be R1, taking volume resistance of the second among the coating-like layers 55 to be R2, and taking volume resistance of the innermost among the coating-like layers 55 to be R3, volume resistances might be chosen such that R1<R2<R3. This is so that there will be no dramatic change in the resistance of charging roller 51 as respective coating-like layers 55 are sequentially stripped off in order from the outermost thereamong, as described below. To maintain constant electric potential at the surface of charging roller 51, it is necessary to adjust bias voltage Vb at bias voltage circuit 52 in correspondence to the resistance of charging roller 51. By reducing the size of the change in resistance of charging roller 51, it is possible to limit the range over which bias voltage Vb from bias voltage circuit 52 must be adjusted, making it possible to decrease the load on bias voltage circuit 52.

Note that adjustment of the volume resistance of respective coating-like layers 55 may be accomplished by changing the amount of electrically conductive particles mixed therewithin.

Furthermore, the reason for having surface roughnesses of not more than Rz 20μ at respective coating-like layers 55 is to limit variation in the gap between photosensitive drum 21 and the outermost among coating-like layers 55, and to limit nonuniformity in electric potential at the surface of photosensitive drum 21. Where bias voltage(s) Vb is/are employed that is/are DC voltage(s) on which AC voltage(s) is/are superposed, by limiting surface roughnesses at respective coating-like layers 55 to not more than Rz 20μ, and by limiting variation in the gap to not more than 20μ, it will be possible to limit nonuniformity in electric potential at the surface of photosensitive drum 21. Furthermore, where bias voltage(s) Vb is/are employed that is/are DC voltage(s), it will not be possible to limit nonuniformity in electric potential at the surface of photosensitive drum 21 unless surface roughnesses at respective coating-like layers 55 are limited to not more than Rz 5μ, and variation in the gap is limited to not more than 5μ.

Figure 6:
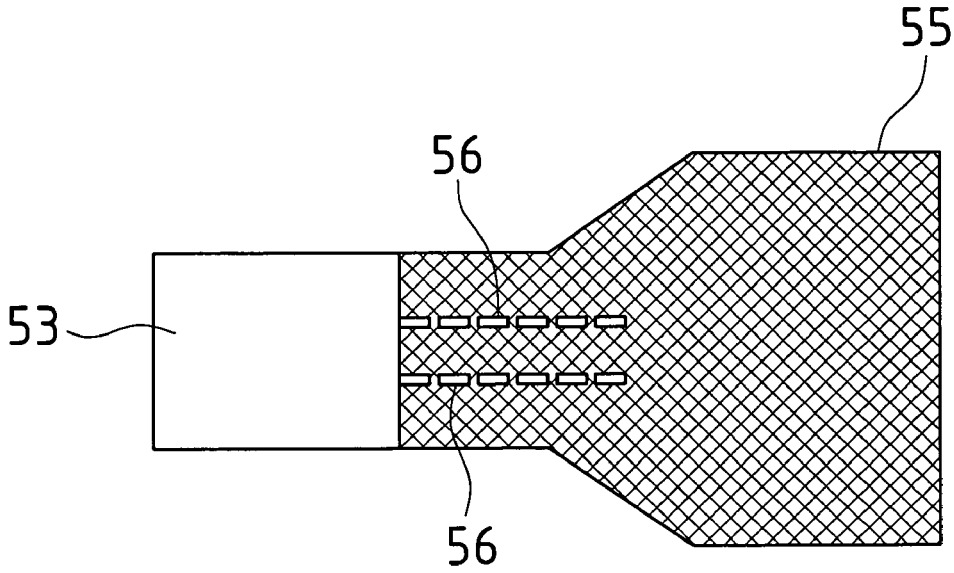
FIG. 6 is an enlarged plan view showing the region in the vicinity of one end of the charging roller of FIG. 5.

Furthermore, the two ends of each of coating-like layers 55 extend beyond elastic member 54, those two ends being made to contract in heat-shrink fashion so as to be brought into direct and intimate contact with rotatable shaft 53. In addition, as shown in FIG. 6, perforation 56 is formed at one end of the outermost among coating-like layers 55. This perforation 56 is to facilitate tearing of coating-like layer 55 by virtue of this perforation 56, and to facilitate stripping off of this coating-like layer 55. Upon stripping off the outermost among coating-like layers 55, one end of the second among coating-like layers 55 is made visible, perforation (not shown) also being formed at one end of this second among coating-like layers 55.

The depth of perforation 56 might, for example, be 20μ (preferably 5μ); where perforation is used, the perforations might have a pitch of on the order of 5 mm. Furthermore, perforation 56 is formed in parallel fashion with respect to the direction in which synthetic resin sheeting making up respective coating-like layers 55 was calendered. This facilitates tearing of coating-like layer(s) 55 along perforation 56.

Where bias voltage(s) Vb is/are employed that is/are DC voltage(s), perforation 56 is formed so as to not be present at region(s) where coating-like layer(s) 55 contact and/or slide against photosensitive drum 21. The reason for this is that if perforation 56 of coating-like layer(s) 55 were to come in contact with photosensitive drum 21, the gap between coating-like layer(s) 55 and photosensitive drum 21 would vary at the location at which this contact occurs, causing nonuniformity in electric potential at the surface of photosensitive drum 21.

However, where bias voltage(s) Vb is/are employed that is/are DC voltage(s) on which AC voltage(s) is/are superposed, because, as mentioned above, there will be less tendency for occurrence of nonuniformity in electric potential at the surface of photosensitive drum 21, there is no objection to forming perforation 56 so as to be present at region(s) where coating-like layer(s) 55 contact and/or slide against photosensitive drum 21.

Furthermore, respective coating-like layers 55 may respectively be colored so as to be of mutually different colors. This will make it possible to more easily know the place in the order of lamination and/or the number of layer(s) remaining at respective coating-like layers 55.

Moreover, when there are many coating-like layers 55, only the innermost among coating-like layers 55, and/or only the second and/or third among coating-like layers 55 as counted from the innermost thereamong, might be colored, so that when layer(s) thereabove among coating-like layers 55 is/are stripped off therefrom the colored layer(s) among coating-like layers 55 would become apparent, indicating that there are not many layer(s) remaining at respective coating-like layers 55. Furthermore, there is no objection to coloring only portion(s) of coating-like layer(s) 55, and/or to using letter(s), number(s), and/or the like instead of coloration to mark place in the order of lamination and/or number of remaining layer(s) at respective coating-like layers 55.

Figure 7:
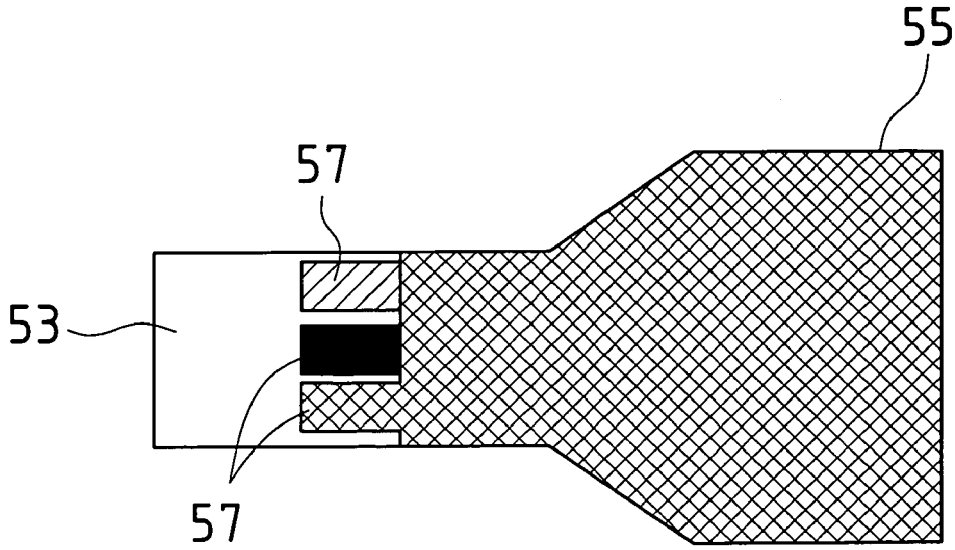
FIG. 7 is an enlarged plan view showing a variation on the charging roller of FIG. 5.

Moreover, instead of using coloration and/or perforation at respective coating-like layers 55, tags 57 may respectively be provided at the end portions of respective coating-like layers 55 as shown in FIG. 7. Respective tags 57 may respectively be colored so as to be of mutually different colors, and may have letter(s), number(s), and/or the like inscribed thereon to indicate place in the order of lamination and/or number of remaining layer(s) at respective coating-like layers 55. Furthermore, respective tags 57 protrude in parallel fashion with respect to the direction in which synthetic resin sheeting making up respective coating-like layers 55 was calendered. This being the case, it is possible by pulling up on tag(s) 57 to easily cause formation of site(s) along which tearing of layer(s) among coating-like layers 55 corresponding to tag(s) 57 can be initiated, stripping off of coating-like layer(s) 55 occurring in simple fashion when initiated from such site(s).

Note, moreover, that there is no objection to causing tags in the form of distinct members to respectively be captured directly beneath the end portions of respective coating-like layers 55.

With such a rotatable roller-type charging apparatus 22, as the outermost among coating-like layers 55 of charging roller 51 is made to contact and/or slide against photosensitive drum 21, charge is applied from the outermost among coating-like layers 55 to photosensitive drum 21, charging photosensitive drum 21. This being the case, resistance of the outermost among coating-like layers 55 of charging roller 51 fluctuates, and the surface thereof become scratched, soiled, and so forth as it gradually deteriorates. Moreover, if remedial action is not taken, charging capability of charging roller 51 will decrease, leading to nonuniformity in charging of photosensitive drum 21 and causing lowering of image quality and/or reduction in service life of photosensitive drum 21.

The outermost among coating-like layer(s) 55 of charging roller 51 is/are therefore periodically stripped off therefrom to rejuvenate the surface of charging roller 51. This makes it possible to reestablish charging capability of charging roller 51 and to proactively prevent nonuniformity in charging of photosensitive drum 21 and/or lowering of image quality, and makes it possible to increase longevity of photosensitive drum 21.

And furthermore, the procedure by which the outermost among coating-like layers 55 of charging roller 51 is/are stripped off therefrom is extremely simple. Moreover, this is extremely advantageous from the standpoint of running cost, conservation of resources, and so forth, when compared with the alternative of replacing the entire charging roller.

Furthermore, because respective coating-like layers 55 are definitively secured, having contracted in the direction of the core, resistance between charging roller 51 and photosensitive drum 21 is made stable, and charging of photosensitive drum 21 is made stable.

Figure 8:
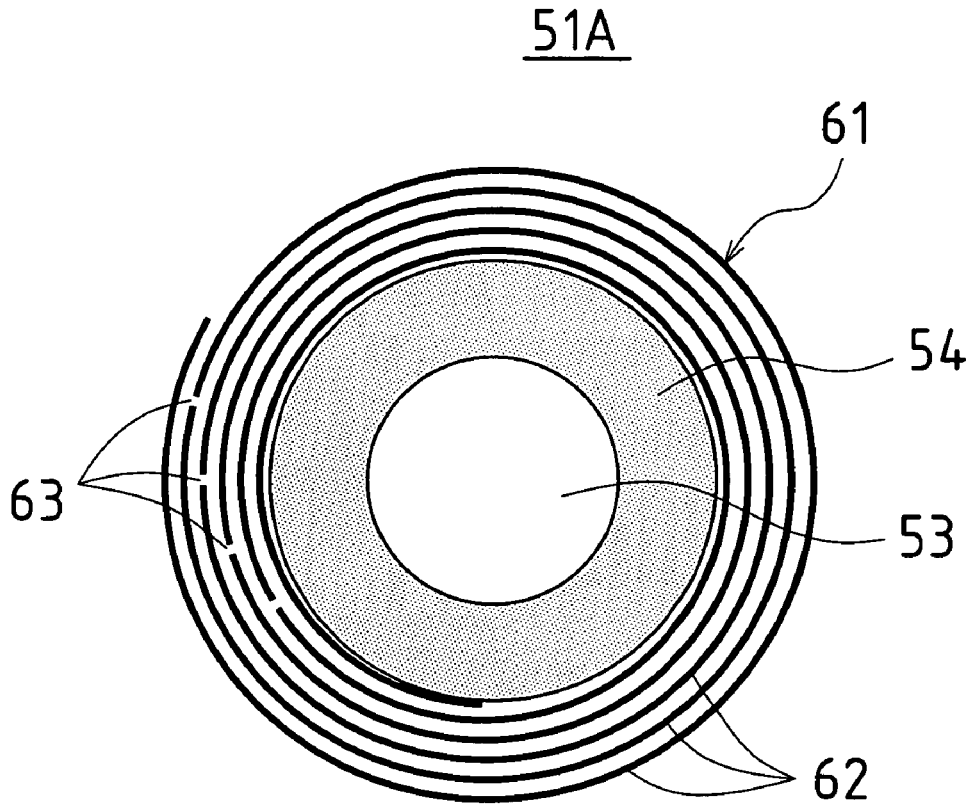
FIG. 8 is a sectional view showing another variation on the charging roller as seen from the side.

FIG. 8 is a sectional view showing a variation on the charging roller. Charging roller 51A of the present variation is such that a single sheet 61 is wrapped about elastic member 54 a plurality of times to form respective coating-like layers 62 in laminated fashion.

Electrically conductive adhesive is present between adjacent layers among respective coating-like layers 62. As a result, respective coating-like layers 62 are definitively secured, resistance between charging roller 51A and photosensitive drum 21 is made stable, and charging of photosensitive drum 21 is made stable.

Furthermore, respective coating-like layers 62 are partitioned by perforation 63 formed at respective locations on sheet 61 so as to extend in the long direction of charging roller 51A.

Figure 9:
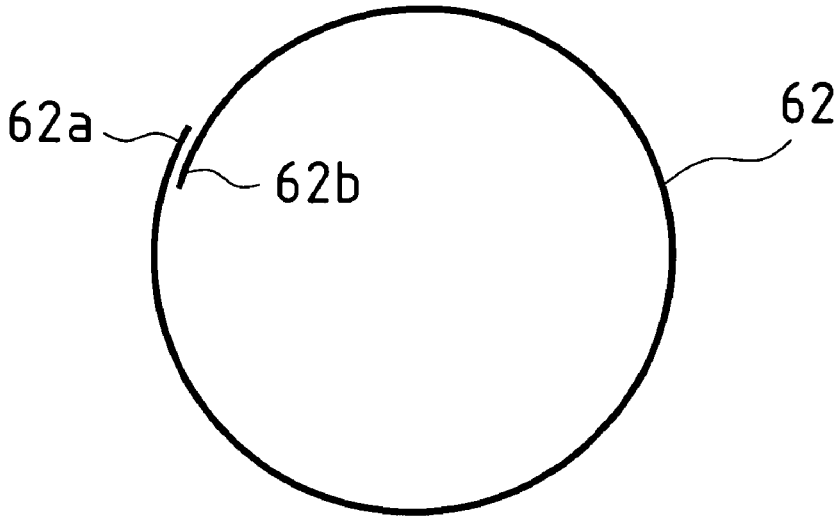
FIG. 9 is a side view showing in schematic fashion one coating-like layer in the charging roller of FIG. 8.

Moreover, as shown in FIG. 9, the lengths of coating-like layers 62 are chosen so as to cause the two edges 62*a*, 62*b* of each of the coating-like layers 62 to slightly mutually overlap. This makes it possible to avoid a situation in which perforation 63 contacts and/or slides against photosensitive drum 21.

Furthermore, taking volume resistance of the outermost among coating-like layers 62 to be R1, taking volume resistance of the second among coating-like layers 62 to be R2, taking volume resistance of the third among coating-like layers 62 to be R3, . . . , and taking volume resistance of the nth among coating-like layers 62 to be Rn, volume resistances are chosen such that R1<R2<R3< . . . <Rn. This makes it possible to avoid any dramatic change in the resistance of charging roller 51A as respective coating-like layers 62 are sequentially stripped off in order from the outermost thereamong, makes it possible to limit the range over which bias voltage Vb from bias voltage circuit 52 must be adjusted to maintain constant electric potential at the surface of charging roller 51A, and makes it possible to decrease the load on bias voltage circuit 52.

Note that adjustment of the volume resistance of respective coating-like layers 62 may be accomplished by changing the amount of electrically conductive particles mixed therewithin.

Furthermore, at least a portion of respective coating-like layer(s) 62 may respectively be colored so as to be of mutually different colors to indicate place in the order of lamination and/or number of remaining layer(s) at respective coating-like layers 62. Alternatively or in addition thereto, tag(s) may respectively be provided at each of coating-like layer(s) 62 in the vicinity of the tip(s) thereof to indicate place in the order of lamination and/or number of remaining layer(s) at respective coating-like layers 62 and/or to facilitate stripping off of coating-like layer(s) 62 by pulling up on the tag(s).

Figure 10:
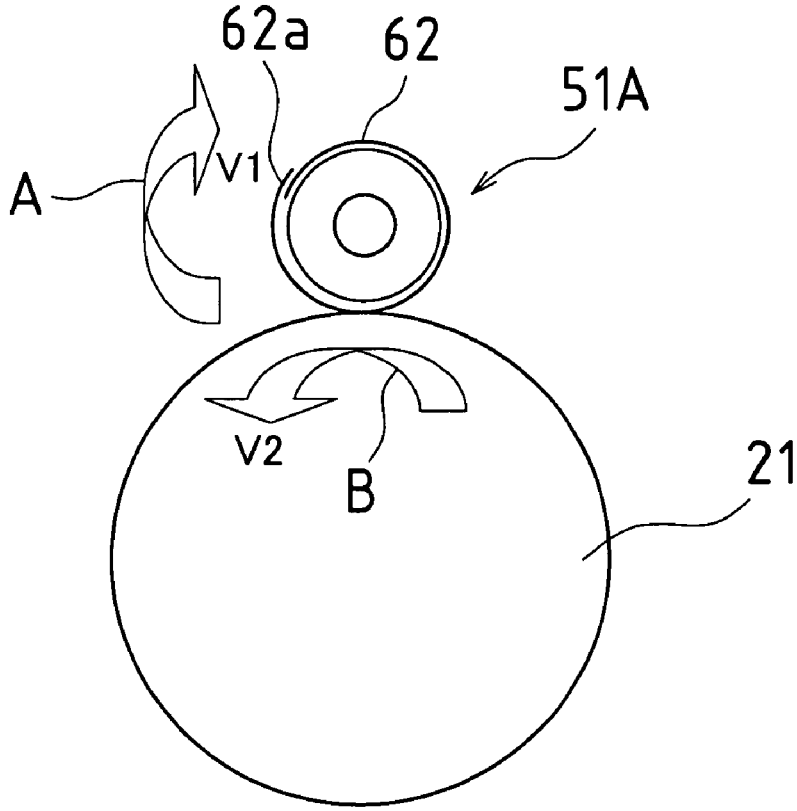
FIG. 10 is a drawing to be used for explaining the relationship between circumferential speed of the charging roller of FIG. 8 and circumferential speed of a photosensitive drum.

Furthermore, at charging roller 51A, as one edge 62*a* of the outermost among coating-like layers 62 appears at the outside circumference of charging roller 51A, there is a tendency for edge 62*a* of the outermost among coating-like layers 62 to serve as site from which delamination of coating-like layer(s) 62 might occur. For this reason, as shown in FIG. 10, where charging roller 51A and photosensitive drum 21 are respectively made to rotate in the directions indicated by arrows A and B, edge 62*a* of the outermost among coating-like layers 62 is directed opposite arrow A; and furthermore, taking the absolute value of the circumferential speed of charging roller 51A to be V1, and taking the absolute value of the circumferential speed of photosensitive drum 21 to be V2, these are chosen so as to satisfy the relationship V1>V2. This counteracts the tendency for edge 62*a* of the outermost among coating-like layers 62 to serve as site from which delamination of coating-like layer(s) 62 might occur.

Moreover, because of the step presented by edge 62*a* of the outermost among coating-like layers 62 at charging roller 51A, bias voltage(s) Vb is/are employed that is/are DC voltage(s) on which AC voltage(s) is/are superposed. By so doing, there will be reduced tendency for occurrence of nonuniformity in electric potential at the surface of photosensitive drum 21 notwithstanding any increase in size of the gap between charging roller 51A and photosensitive drum 21 at the location of the step presented by the outermost among coating-like layers 62.

Figure 11:
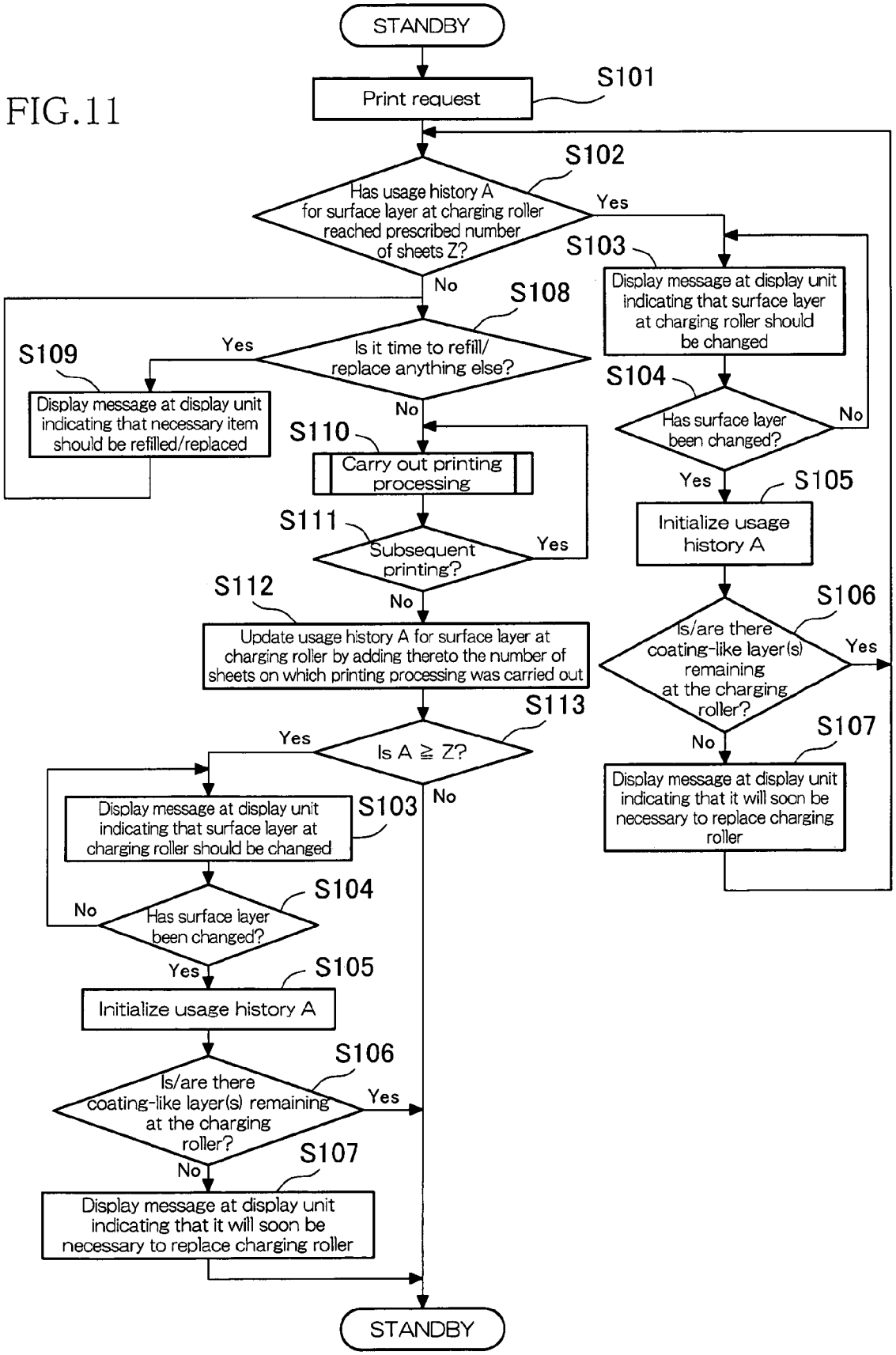
FIG. 11 is a flowchart indicating processing in connection with determination and communication of time(s) at which to strip off coating-like layer(s) at charging roller(s) in the image forming apparatus of FIG. 1.

Next, following the flowchart shown in FIG. 11, processing in connection with determination and communication of time(s) at which to strip off coating-like layer(s) at charging roller 51 in image forming apparatus 1 will be described.

First, when there is a print request as a result of operation of control panel 14 of image forming apparatus 1 (step S101), this print request is communicated to main controller 43 by way of display/control panel unit 44. Upon receipt of such a print request, main controller 43 reads usage history A (at least one member selected from among the group consisting of number of times charged, number of rotations, and time spent rotating) for charging roller 51 of roller-type charging apparatus 22 from main storage unit 42, and determines whether this usage history A of charging roller 51 has reached a particular value Z (step S102). And if usage history A of charging roller 51 has reached the particular value Z ("Yes" at step S102), a message urging that the outermost among coating-like layers 55 of charging roller 51 be stripped off therefrom is displayed at the liquid crystal display unit of control panel 14 by way of display/control panel unit 44 (step S103).

Moreover, when a user strips off the outermost among coating-like layers 55 of charging roller 51 and operates control panel 14 to cause entry of input to the effect that the procedure has been completed ("Yes" at step S104), main controller 43 initializes usage history A at main storage unit 42 (step S105) in response thereto and ascertains the number of layer(s) remaining among coating-like layers 55 of charging roller 51; and if the number of remaining layers is, for example, two or more ("Yes" at step S106), processing returns to step S102. Furthermore, if the number of remaining layers is less than two ("No" at step S106), main controller 43 causes a message indicating that it will soon be time to replace charging roller 51 to be displayed at the liquid crystal display unit of control panel 14 by way of display/control panel unit 44 (step S107).

At the same time, main controller 43 controls bias voltage circuit 52 so as to decrease bias voltage Vb applied to charging roller 51 by an amount corresponding to the decrease in the resistance of charging roller 51 resulting from the stripping off of the outermost among coating-like layers 55 of charging roller 51, permitting constant electric potential to be maintained at the surface of charging roller 51 and permitting constant electric potential to be maintained at the surface of photosensitive drum 21.

Furthermore, if usage history A of charging roller 51 has not reached the particular value Z ("No" at step S102), main controller 43 carries out determination as to whether the time for refilling/replacement has arrived, this determination being carried out separately for each of the various units such as photosensitive drum 21, development unit 24, transfer unit 25, cleaning unit 26, the charge-removing unit, and so forth (step S108). Moreover, if there is/are unit(s) for which the time for refilling/replacement has arrived ("Yes" at step S108), a message urging refilling/replacement of such unit(s) is displayed at the liquid crystal display unit of control panel 14 by way of display/control panel unit 44 (step S109).

Furthermore, if there is no unit for which the time for refilling/replacement has arrived ("No" at step S108), main controller 43 controls original transport unit 2, capturing unit 3, printing unit 4, recording paper transport unit 5, media supply unit 6, and so forth in response to print request(s) at step S101, causing image(s) of original(s) to be recorded onto recording paper (step S110). Moreover, if subsequent original(s) is/are present ("Yes" at step S111), processing at step S110 is repeated; if no subsequent original is present ("No" at step S111), usage history A at main storage unit 42 is updated in correspondence to the printing processing taking place at this time (step S112), and determination is made as to whether this updated usage history A has reached the particular value Z (step S113). And if this updated usage history A has reached the particular value Z ("Yes" at step S113), processing as described above at respective steps S103 through S107 is repeated; if this updated usage history A has not reached the particular value Z ("No" at step S113), a standby state is entered as subsequent print request(s) is/are awaited.

Thus, because usage history A of charging roller 51 is ascertained, and because time(s) at which coating-like layer (s) 55 should be stripped off is/are ascertained and reported based on this usage history A, it is possible at appropriate time(s) to strip off coating-like layer(s) 55 and rejuvenate the surface of charging roller 51. This makes it possible to prevent damage to the surface of photosensitive drum 21 and to increase longevity of photosensitive drum 21. Furthermore, user(s) need not go to any great lengths with regard to time(s) at which coating-like layer(s) 55 should be stripped off.

Note that while description was carried out here using the example of charging roller 51 (see, e.g., FIG. 5), there is no objection to using charging roller 51A (see, e.g., FIG. 8). Furthermore, while description was carried out using the example of a usage history of charging roller 51, there is no objection to instead utilizing usage history or histories of photosensitive drum 21 (at least one member selected from among the group consisting of number of images recorded by photosensitive drum 21, number of rotations of photosensitive drum 21, and time that photosensitive drum 21 has spent rotating). This is because charging roller 51 and photosensitive drum 21 always operate simultaneously. In particular, where a cartridge in which charging roller 51 and photosensitive drum 21 are present together in integral fashion is removably installed at image forming apparatus 1 and can be replaced, there is no objection to utilizing a usage history of photosensitive drum 21 instead of a usage history of charging roller 51. Moreover, where a cartridge in which charging roller 51 and photosensitive drum 21 are present together in integral fashion is employed, place in the order of lamination, number of remaining layers, and/or the like at the outermost among coating-like layers 55 of charging roller 51 may be used as benchmark(s) for determining cartridge recycle time(s).

Furthermore, application of the rotatable roller aspect of the technology disclosed herein is not limited only to charging roller 51 of roller-type charging apparatus 22, it also being possible to apply the technology disclosed herein to transfer roller(s) at transfer unit 25, cleaning roller(s) at cleaning unit 26, charge-removing roller(s) at the charge-removing unit (not shown), and so forth in image forming apparatus 1.

Moreover, the technology disclosed herein may be embodied in a wide variety of forms other than those presented herein without departing from the spirit or essential characteristics thereof. The foregoing embodiments and working examples, therefore, are in all respects merely illustrative and are not to be construed in limiting fashion. The scope of the technology disclosed herein being as indicated by the claims, it is not to be constrained in any way whatsoever by the body of the specification. All modifications and changes within the range of equivalents of the claims are, moreover, within the scope of the technology disclosed herein.

What is claimed is:

1. A rotatable roller comprising a plurality of coating-like layers sequentially strippably laminated at an outer circumference; and capable of rotating with an outer circumferential surface thereof contacting and/or sliding against at least one electrostatic latent image carrier, wherein the respective coating-like layers have mutually different resistances, the more outwardly located the coating-like layer the lower being the resistance thereof.

2. A rotatable roller according to claim 1 comprising:

one or more cores; and one or more intermediate members provided about at least one of the core or cores;

wherein the plurality of coating-like layers are laminated about at least one of the intermediate member or members.

3. A rotatable roller according to claim 1 wherein at least a portion of at least one of the respective coating-like layers is colored.

4. A rotatable roller according to claim 3 wherein stripping off any of the respective coating-like layers causes at least a part of the colored portion to be made visible.

5. A rotatable roller according to claim 1 wherein at least one of the respective coating-like layers has one or more tags attached thereto.

6. A rotatable roller according to claim 5 wherein marked on at least one of the tag or tags is an order in which at least one of the coating-like layer or layers to which at least one of the tag or tags is attached is to be stripped off.

7. A rotatable roller according to claim 1 wherein perforation is present at at least a portion of at least one of the respective coating-like layers.

8. A rotatable roller according to claim 7 wherein the perforation is not present at at least one region where at least one of the coating-like layers contacts and/or slides against at least one of the electrostatic latent image carrier or carriers.

9. A rotatable roller according to claim 7 wherein at least a portion of the perforation is formed in parallel fashion with respect to at least one direction of calendering of synthetic resin sheeting making up at least one of the coating-like layers.

10. A rotatable roller according to claim 1 wherein electrically conductive adhesive is present between adjacent layers of the respective coating-like layers.

11. A rotatable roller according to claim 1 wherein the respective coating-like layers are brought into mutual intimate contact through contraction thereof.

12. A rotatable roller according to claim 1 wherein the respective coating-like layers comprise a plurality of concentrically laminated tubes.

13. A rotatable roller according to claim 1 wherein the respective coating-like layers are formed in laminated fashion such that a single sheet is wrapped thereabout a plurality of times.

14. A rotatable roller according to claim 13 wherein the respective coating-like layers are partitioned by perforation formed on the sheet so as to extend in substantially the long direction of the rotatable roller.

15. A rotatable roller according to claim 14 wherein each of the coating-like layers is of such length as to cause the two edges of the coating-like layer to mutually overlap.

16. An image forming apparatus comprising at least one of the rotatable roller or rotatable rollers according to claim 1.

17. An image forming apparatus according to claim 16 comprising:

one or more control means recording usage history information pertaining to at least one of the rotatable roller or rotatable rollers, and ascertaining, based on at least a portion of the usage history information, at least one time at which at least one of the coating-like layers of at least one of the rotatable roller or rotatable rollers should be stripped off.

18. An image forming apparatus according to claim 17 comprising:

one or more report means reporting at least one time at which at least one of the coating-like layers of at least one of the rotatable roller or rotatable rollers should be stripped off.

19. An image forming apparatus according to claim 18 wherein at least a portion of the usage history information pertaining to at least one of the rotatable roller or rotatable rollers is at least one member selected from among the group consisting of:

at least one number of times that at least one of the rotatable roller or rotatable rollers has been electrically charged;

at least one number of rotations of at least one of the rotatable roller or rotatable rollers; and at least one time that at least one of the rotatable roller or rotatable rollers has spent rotating.

20. An image forming apparatus according to claim 17 wherein at least a portion of the usage history information pertaining to at least one of the rotatable roller or rotatable rollers is ascertained based on at least one member selected from among the group consisting of:

at least one number of images recorded by at least one of the electrostatic latent image carrier or carriers;

at least one number of rotations of at least one of the electrostatic latent image carrier or carriers; and at least one time that at least one of the electrostatic latent image carrier or carriers has spent rotating.

21. An image forming apparatus cartridge:

comprising at least one rotatable roller wherein said rotatable roller comprises a plurality of coating-like layers sequentially strippably laminated at an outer circumference;

wherein said rotatable roller is capable of rotating with an outer circumferential surface thereof contacting and/or sliding against at least one electrostatic latent image carrier, wherein the respective coating-like layers have mutually different resistances, the more outwardly located the coating-like layer the lower being the resistance thereof; and wherein said image forming apparatus cartridge is capable of being removably installed in one or more image forming apparatuses.

* * * * *